US011361709B2

(12) United States Patent
Pyun et al.

(10) Patent No.: US 11,361,709 B2
(45) Date of Patent: Jun. 14, 2022

(54) DISPLAY DEVICE

(71) Applicant: SAMSUNG DISPLAY CO., LTD., Yongin-si (KR)

(72) Inventors: Ki Hyun Pyun, Yongin-si (KR); Jang Mi Lee, Yongin-si (KR); Eun Jin Choi, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/410,481

(22) Filed: Aug. 24, 2021

(65) Prior Publication Data

US 2022/0157224 A1 May 19, 2022

(30) Foreign Application Priority Data

Nov. 17, 2020 (KR) ..... 10-2020-0154034

(51) Int. Cl.
*G09G 3/32* (2016.01)
*G09G 3/20* (2006.01)

(52) U.S. Cl.
CPC ..... *G09G 3/32* (2013.01); *G09G 3/2007* (2013.01); *G09G 2300/0842* (2013.01); *G09G 2310/027* (2013.01); *G09G 2310/08* (2013.01); *G09G 2330/021* (2013.01); *G09G 2360/08* (2013.01)

(58) Field of Classification Search
CPC ..... G09G 3/32; G09G 3/2007; G09G 2300/0842; G09G 2310/027; G09G 2310/08; G09G 2330/021; G09G 2360/08
See application file for complete search history.

(56) References Cited

U.S. PATENT DOCUMENTS

| | | | | |
|---|---|---|---|---|
| 8,054,258 | B2 | 11/2011 | Choi et al. | |
| 8,558,767 | B2 | 10/2013 | Kwon | |
| 9,041,626 | B2 | 5/2015 | Park et al. | |
| 2018/0174527 | A1* | 6/2018 | Botzas | G09G 3/2003 |
| 2018/0190218 | A1* | 7/2018 | Jang | G09G 3/3611 |
| 2018/0226028 | A1* | 8/2018 | Park | G09G 3/3266 |
| 2018/0247591 | A1* | 8/2018 | Kim | G09G 3/3233 |
| 2019/0081471 | A1* | 3/2019 | Park | G09G 3/3266 |
| 2019/0172387 | A1* | 6/2019 | Choi | G09G 3/3611 |

(Continued)

FOREIGN PATENT DOCUMENTS

| | | |
|---|---|---|
| KR | 10-0639005 | 10/2006 |
| KR | 10-0844770 | 7/2008 |

(Continued)

*Primary Examiner* — Andrew Sasinowski
(74) *Attorney, Agent, or Firm* — F. Chau & Associates, LLC

(57) ABSTRACT

A display device includes pixels divided into blocks, a timing controller to generate image data based on input image data, a data driver to generate a data signal corresponding to the image data and supply the data signal to the pixels, and power supply to supply a power voltage to the pixels. In addition, the display device includes a power controller to calculate a first load value corresponding to the pixels, second load values corresponding to each of the blocks, and first peak grayscale values corresponding to each of the blocks based on the input image data. The power controller generates a power control signal to change a voltage level of the power voltage based on the first load value, the second load values, and the first peak grayscale values.

20 Claims, 10 Drawing Sheets

(56) References Cited

U.S. PATENT DOCUMENTS

| | | | | |
|---|---|---|---|---|
| 2019/0189077 | A1* | 6/2019 | Zhao | G09G 3/3655 |
| 2019/0213958 | A1* | 7/2019 | Cho | H01L 27/3276 |

FOREIGN PATENT DOCUMENTS

| | | |
|---|---|---|
| KR | 10-0893482 | 4/2009 |
| KR | 10-0894606 | 4/2009 |
| KR | 10-2016-0047083 | 5/2016 |
| KR | 10-2102697 | 4/2020 |

* cited by examiner

DISPLAY DEVICE

CROSS-REFERENCE TO RELATED APPLICATIONS

This application claims priority to Korean Patent Application No. 10-2020-0154034, filed on Nov. 17, 2020, and all the benefits accruing therefrom under 35 U.S.C. § 119, the content of which in its entirety is herein incorporated by reference.

BACKGROUND

1. Field

One or more embodiments described herein relate to a display device.

2. Description of the Related Art

To reduce power consumption, a display device may control the magnitude of a power voltage of its display panel based on the load value and grayscale values of input data. According to the image being displayed, the load value and grayscale values may vary among different display areas. When the magnitude of the power voltage is controlled without considering the load value and grayscale values for different display areas, the quality of the displayed image may be adversely affected.

SUMMARY

One or more embodiments described herein provide a display device capable of reducing or minimizing power consumption.

One or more embodiments may reduce or minimize power consumption by controlling a power voltage of a display panel.

One or more embodiments may control the level of the power voltage.

One or more embodiments may control the level of the power voltage in a way that prevents a reduction in visual recognition ability of the displayed image by a user caused by a luminance change.

These aforementioned features are not to limit the scope of the disclosed embodiments and claims, and are provided as examples of certain features that may result in one or more implementations. One or more of the disclosed embodiments may achieve these features and/or other features.

In accordance with one or more embodiments, a display device includes a pixel unit including pixels divided into blocks, a timing controller configured to generate image data based on input image data, a data driver configured to generate a data signal corresponding to the image data and supply the data signal to the pixels, and a power supply configured to supply a power voltage to the pixel unit. The display device also includes or is coupled to a power controller configured to calculate a first load value corresponding to the pixels in the pixel unit, second load values corresponding to each of the blocks and first peak grayscale values corresponding to each of the blocks based on the input image data, and to generate a power control signal to change a voltage level of the power voltage based on the first load value, the second load values, and the first peak grayscale values.

In accordance with one or more embodiments, an apparatus includes a controller configured to calculate a first load value corresponding to pixels in a display panel, second load values corresponding to each of blocks included divided ones of the pixels, and first peak grayscale values corresponding to each of the blocks based on the input image data. The controller generates a power control signal to change a voltage level of the power voltage based on the first load value, the second load values, and the first peak grayscale values.

BRIEF DESCRIPTION OF THE DRAWINGS

The above and other features are apparent by describing in further detail embodiments thereof with reference to the accompanying drawings, in which.

DETAILED DESCRIPTION OF THE EMBODIMENT

Figure 1:
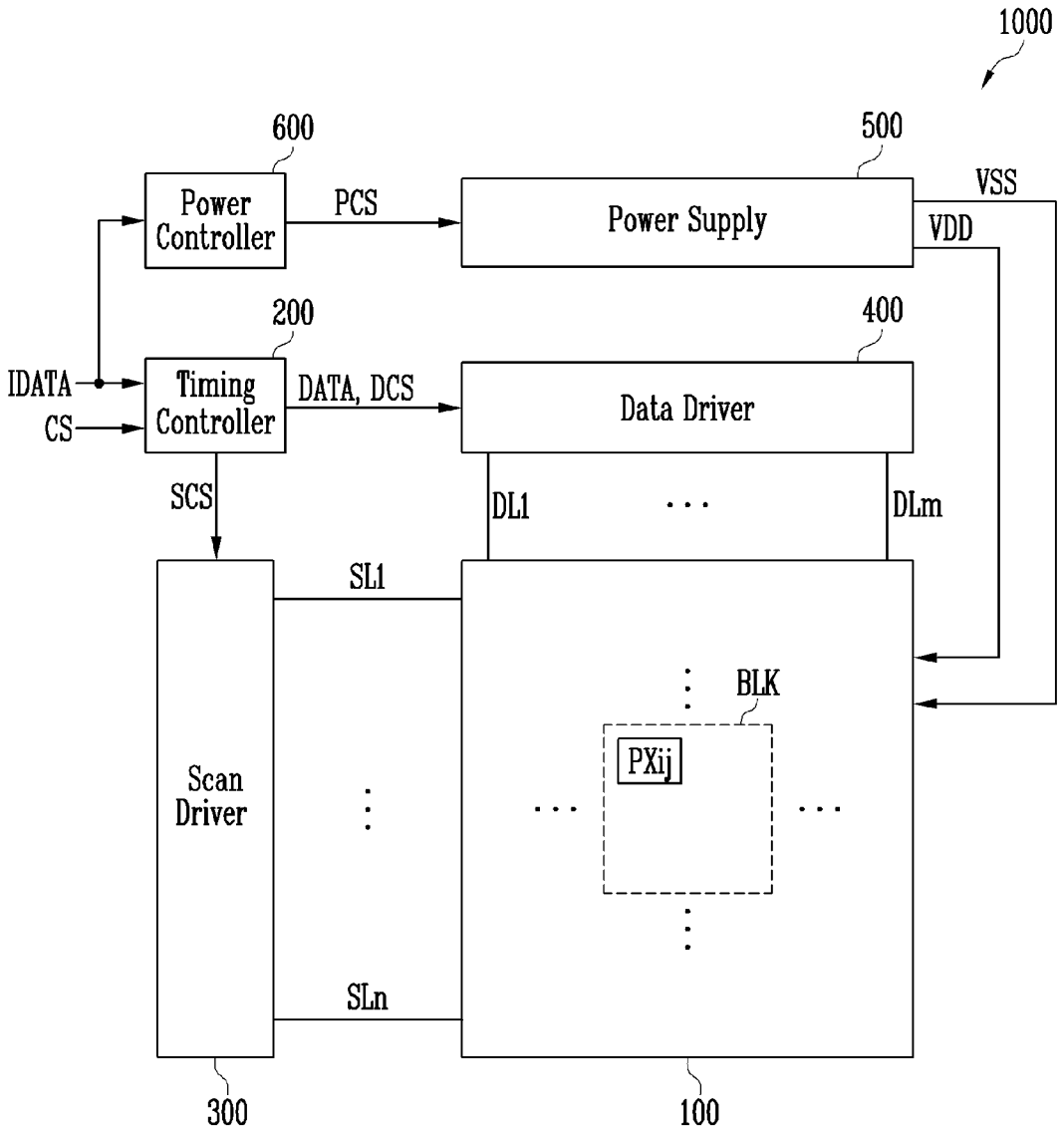
FIG. 1 illustrates an embodiment of a display device.

The disclosure may be modified in various manners and have various forms. Therefore, specific embodiments will be illustrated in the drawings and will be described in detail in the specification. However, it should be understood that the disclosure is not intended to be limited to the disclosed specific forms, and the disclosure includes all modifications, equivalents, and substitutions within the spirit and technical scope of the disclosure.

Similar reference numerals are used for similar components in describing each drawing. In the accompanying drawings, the dimensions of the structures are shown enlarged from the actual dimensions for the sake of clarity of the disclosure. Terms of "first", "second", and the like may be used to describe various components, but the components should not be limited by the terms. The terms are used only for the purpose of distinguishing one component from another component. For example, without departing from the scope of the disclosure, a first component may be referred to as a second component, and similarly, a second component may also be referred to as a first component. The singular expressions include plural expressions unless the context clearly indicates otherwise.

It should be understood that in the present application, a term of "include", "have", or the like is used to specify that there is a feature, a number, a step, an operation, a component, a part, or a combination thereof described in the specification, but does not exclude a possibility of the presence or addition of one or more other features, numbers, steps, operations, components, parts, or combinations thereof in advance. In addition, a case where a portion is "connected" to another portion, the case includes not only a case where the portion is directly connected to the other portion but also a case where the portion is connected to the other portion with another element interposed therebetween.

FIG. 1 is a block diagram illustrating an embodiment of a display device 1000, which may include a display panel 100, a timing controller 200, a scan driver 300, a data driver 400, a power supply 500, and a power controller 600. In one embodiment, the power controller 600 may be an external element coupled to the display device.

The display panel 100 (or a pixel unit) includes pixels PXij that output light to display an image, where i and j are integers greater than 0. Each pixel PXij may be connected to a corresponding data line and scan line. In one embodiment, each pixel PXij may include a scan transistor connected to an i-th scan line and a j-th data line. The circuit configurations of the pixels PXij may vary among embodiments.

Each pixel PXij may receive voltages (e.g., power voltages) of first power VDD and second power VSS from the power supply 500. The first power VDD and second power VSS may be voltages to perform one or more operations of the pixels. The first power VDD may have a voltage level different from (e.g., greater than) that of the second power VSS. In one embodiment, the first power voltage VDD may be a positive voltage, and the second power voltage VSS may be a negative voltage or a ground voltage.

According to embodiments, the display panel 100 may be divided into a plurality of blocks BLK, each of which may include at least one pixel PXij. In one embodiment, each block BLK may include the same number of pixels PXij. In another embodiment, two or more blocks may include a different number of pixels PXij.

The timing controller 200 may receive input image data IDATA and a control signal CS from at least one external source. The control signal CS may include, for example, a synchronization signal, a clock signal, and/or one or more other signals. The input image data IDATA may include or correspond to at least one image frame.

The timing controller 200 may generate a first control signal SCS (or a scan control signal) and a second control signal DCS (or a data control signal) based on the control signal CS. The timing controller 200 may supply the first control signal SCS to the scan driver 300 and may supply the second control signal DCS to the data driver 400.

The first control signal SCS may include, for example, a scan start signal, a clock signal, and/or other signals. The scan start signal may control the timing of the scan signal, and the clock signal may be used as a basis to shift the scan start signal.

The second control signal DCS may include a source start signal, a clock signal, and/or other signals. The source start signal may control a sampling start time point of data, and the clock signal may be used to control a sampling operation.

The timing controller 200 may rearrange the input image data IDATA to generate image data DATA of a digital format, and may provide the image data DATA to the data driver 400.

The scan driver 300 may receive the first control signal SCS from the timing controller 200 and may supply scan signals to scan lines SL1 to SLn, where n may be an integer greater than 0. The scan signals may be supplied to the scan lines SL1 to SLn in response to the first control signal SCS. In one embodiment, the scan driver 300 may sequentially supply the scan signals to the scan lines SL1 to SLn. When the scan signals are sequentially supplied, the pixels PXij may be selected in a horizontal line unit (or pixel row unit), and data signals may be supplied to the selected pixels PXij. Each scan signal may be set to a gate on voltage (e.g., low voltage or high voltage) so that a transistor (for example, a scan transistor) in a corresponding one of the pixels PXij may be turned on.

The data driver 400 may receive the image data DATA and the second control signal DCS from the timing controller 200, may convert the image data DATA of the digital format to a data signal (data voltage) of an analog format in response to the second control signal DCS, and may supply the data signal to data lines DL1 to DLm, where m may be an integer greater than 0. The data signals supplied to the data lines DL1 to DLm may be supplied to the pixels PXij selected by the scan signals. The data driver 400 may supply each of the data signals to the data lines DL1 to DLm in synchronization with the scan signal.

The power supply 500 may supply the voltage of the first power VDD and the voltage of the second power VSS to the pixels PXij of the display panel 100. For example, the power supply 500 may receive an input voltage (for example, a DC power voltage) from an external source (for example, a battery), generate the voltage of the first power VDD and the voltage of the second power VSS using the input voltage, and supply the voltage of the first power VDD and the voltage of the second power VSS to the display panel 100.

The power controller 600 may calculate a peak grayscale value among grayscale values of the input image data IDATA, and may then calculate a load value corresponding to each image frame of the input image data IDATA. The load value may correspond, for example, to grayscale values of the image frame. In one embodiment, the load value of an image frame may increase as a sum of the grayscale values of the image frame increases.

For example, the load value may be 100 in a full-white image frame and may be 0 in a full-black image frame. A full-white image frame may be an image frame in which all or a predetermined number of pixels of the display panel 100 are set to maximum grayscale values (e.g., white grayscale values) to emit light with a maximum luminance. A full-black image frame may be an image frame in which all or a predetermined number of pixels of the display panel 100 are set to the lowest grayscale values (e.g., black grayscale values) and thus do not emit light. Thus, in one embodiment, load value may have a value between 0 and 100, inclusive.

The peak grayscale value and the load value of the input image data IDATA may be different according to a display image. When the peak grayscale value of the input image data IDATA is relatively high, a driving current amount for the display image may be relatively high. When the load value corresponding to the image frame of the input image data IDATA is relatively high, the amount of driving current for the display image may be relatively high. In this case, a relatively high voltage of the first power VDD may be used for the display image.

In contrast, when the peak grayscale value of the input image data IDATA is relatively low, the amount of driving current for the display image may be relatively low. When the load value corresponding to the image frame of the input image data IDATA is relatively low, the driving current amount for the display image may be relatively low. In this case, even though the display device 1000 supplies a relatively low voltage of the first power VDD to the display panel 100, the driving current amount for the display image may be sufficiently secured.

Accordingly, the power controller 600 may generate a power control signal PCS to control the voltage level of the first power VDD in correspondence with the peak grayscale value of the input image data IDATA, and/or the load value corresponding to the image frame of the input image data IDATA. For example, the power controller 600 may decrease a voltage difference between the first power VDD and the second power VSS by decreasing the voltage level of the first power VDD of a positive polarity. Accordingly, power consumption may be reduced or minimized.

The load value and/or the peak grayscale value may be different for each block BLK of the display panel 100 according to the display image. The visual recognition ability of a displayed image by a user due to a luminance change may be different based on the load value and/or peak grayscale value different for each block BLK.

For example, when the difference of the load value and/or the peak grayscale value between or among adjacent blocks BLK is large (e.g., above a first predetermined level), the visual recognition ability for the luminance change may decrease. When the difference of the load value and/or the peak grayscale value between adjacent blocks BLK is small (e.g., below the first predetermined level, or another predetermined level spaced from the first predetermined level), visual recognition ability for the luminance change may increase.

The luminance of a displayed image may change in correspondence with control of the voltage level of the first power VDD. Thus, even in the case where both the total load value of input image data IDATA is substantially the same and the peak grayscale value of the input image data IDATA is the same, when the difference of the load value and/or the peak grayscale value between or among adjacent blocks BLK is small (e.g., below a predetermined level), a significant reduction in the visual recognition ability of a displayed image by a user, caused by the luminance change (for example, a luminance decrease), may occur.

According to one or more embodiments, the power controller 600 may calculate the load value and the peak grayscale value of each block BLK based on the input image data IDATA, and then may control the voltage level of the first power VDD based on the load value and the peak grayscale value of each blocks BLK to prevent or reduce the degree of a visibility reduction of a displayed image due to a luminance change.

In one embodiment, the power controller 600 may decrease the voltage difference between the first power VDD and the second power VSS by increasing the voltage level of the second power VSS of a negative polarity. In one embodiment, the power controller 600 may control the voltage levels of both the first power VDD and the second power VSS to reduce the voltage difference between them. The power controller 600 may therefore control the voltage level of the first power VDD according to various embodiments, described in greater detail below.

Figure 2:
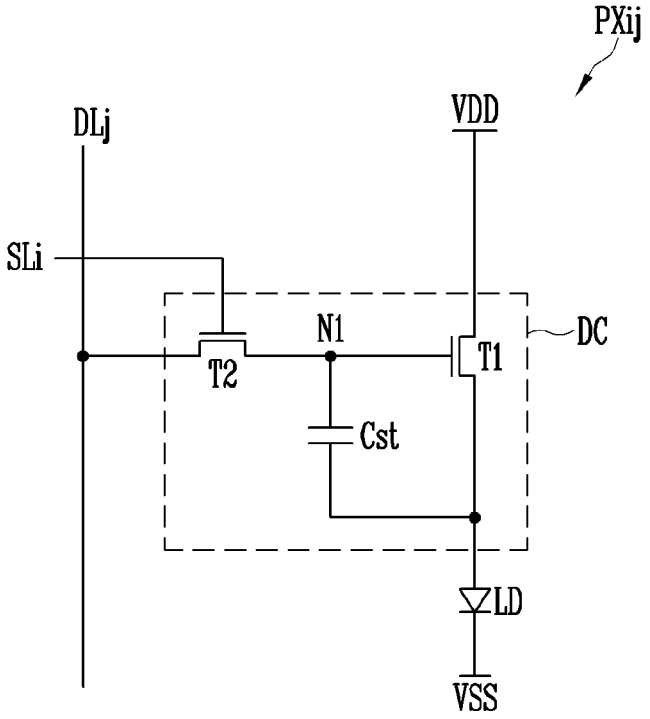
FIG. 2 illustrates an embodiment of a pixel.

FIG. 2 is a circuit diagram illustrating an embodiment of pixel PXij, which may include a light emitting element LD and a driving circuit DC connected thereto to drive the light emitting element LD. The light emitting element LD may include a first electrode (for example, an anode electrode) connected to the first power VDDL via the driving circuit DC and a second electrode (for example, a cathode electrode) connected to the second power VSSL. The light emitting element LD may emit light with a luminance corresponding to an amount of driving current controlled by the driving circuit DC.

The light emitting element LD may be, for example, an organic light emitting diode or an inorganic light emitting diode (e.g., a micro light emitting diode (LED) or a quantum dot light emitting diode). In one embodiment, the light emitting element LD may be an element configured of complex organic and inorganic materials. In FIG. 2, pixel PXij includes a single light emitting element LD, may include a plurality of light emitting elements in another embodiment. In this latter case, the plurality of light emitting elements may be connected with each other in series, in parallel, or in series and parallel.

The first power VDD and the second power VSS may have different potentials. For example, the first power voltage VDD may be greater than the second power voltage VSS.

The driving circuit DC may include a first transistor T1, a second transistor T2, and a storage capacitor Cst. The first transistor T1 (a driving transistor) may have a first electrode electrically connected to the first power VDD and a second electrode electrically connected to the first electrode (for example, the anode electrode) of the light emitting element LD. A gate electrode of the first transistor T1 may be connected to a first node N1. The first transistor T1 may control the driving current amount supplied to the light emitting element LD in correspondence with the data signal supplied to the first node N1 through the data line DLj.

The second transistor T2 (a switching transistor) may include a first electrode connected to the data line DLj, its second electrode may be connected to the first node N1, a gate electrode connected to the scan line SLi. The second transistor T2 may be turned on when a scan signal of a voltage (for example, a gate-on voltage) at which the second transistor T2 may be turned on is supplied from the scan line SLi, to electrically connect the data line DLj and the first node N1. At this time, the data signal of a corresponding frame may be supplied to the data line DLj. Thus the data signal may be transferred to the first node N1. A voltage corresponding to the data signal transferred to the first node N1 may be stored in the storage capacitor Cst.

The storage capacitor Cst may have one electrode connected to the first node N1 and another electrode connected to the first electrode of the light emitting element LD. The storage capacitor Cst may be charged with the voltage corresponding to the data signal supplied to the first node N1, and may maintain the charged voltage until the data signal of the next frame is supplied.

In FIG. 2, one embodiment of the driving circuit DC of pixel PXij is shown, but the driving circuit DC may have a different configuration in another embodiment. For example, the driving circuit DC may include other circuit elements, e.g., one or more of a compensation transistor for compensating a threshold voltage of the first transistor T1, an initialization transistor for initializing the first node N1, and/or a light emission control transistor for controlling light emission time of the light emitting element LD, and a boosting capacitor for boosting the voltage of the first node N1. In addition, in FIG. 2, the transistors in the driving circuit DC, for example, the first and second transistors T1 and T2 are shown as N-type transistors, but at least one of the first or second transistors T1 or T2 may be a P-type transistor.

Figure 3:
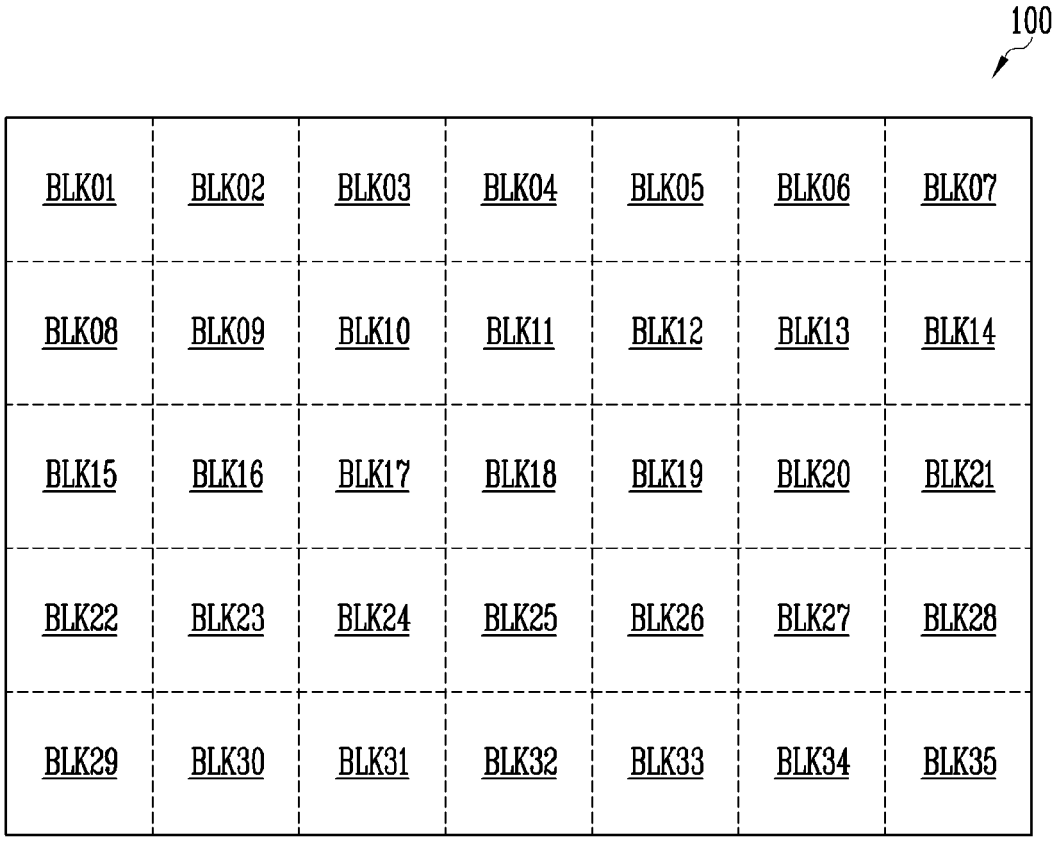
FIG. 3 illustrates an embodiment of a display panel.

FIG. 3 is a diagram illustrating an embodiment of display panel 100, which may include a plurality of blocks. In this embodiment, the pixels of display panel 100 may be divided into a plurality of blocks BLK01 to BLK35, with each of the blocks BLK01 to BLK35 including at least one pixel. The number of blocks BLK01 to BLK35 may be equal to or less than the number of pixels.

In an embodiment, blocks BLK01 to BLK35 may have substantially the same size. In this case, each of the blocks BLK01 to BLK35 may include substantially the same number of pixels. In one embodiment, one or more of the blocks BLK01 to BLK35 may share one or more pixels and/or some of the blocks BLK01 to BLK35 may include pixels that are not in other blocks. In one embodiment, two or more of the blocks BLK01 to BLK35 may have different numbers of pixels. In FIG. 3, the display panel 100 is divided into 35 blocks BLK01 to BLK35, but may be divided into a different number of blocks in another embodiment, for example, according to the design of the display device 1000.

Figure 4:
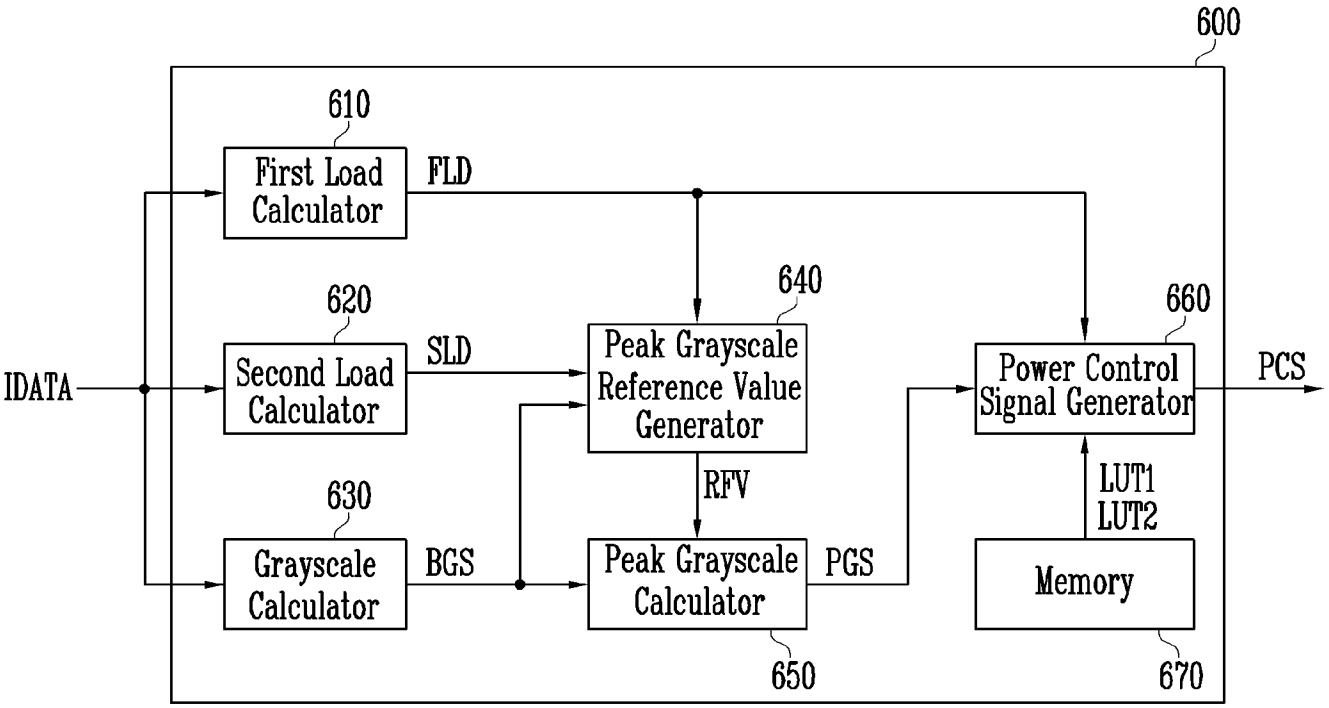
FIG. 4 illustrates an embodiment of a power controller.
Figure 5:
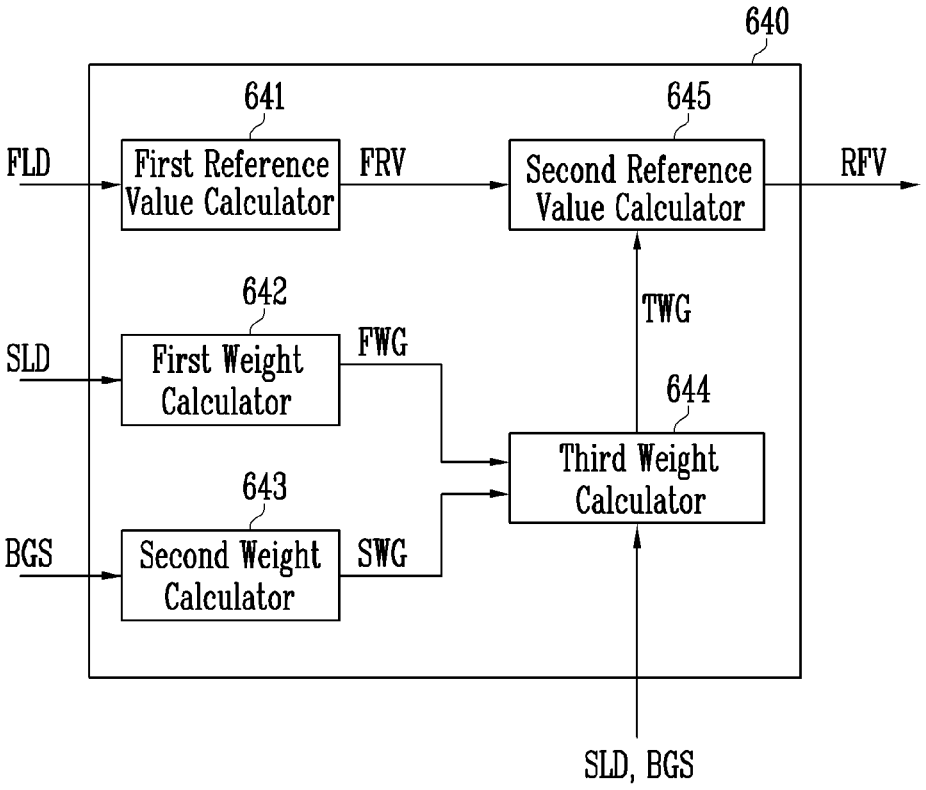
FIG. 5 illustrates an embodiment of a peak grayscale reference value generator.
Figure 10:
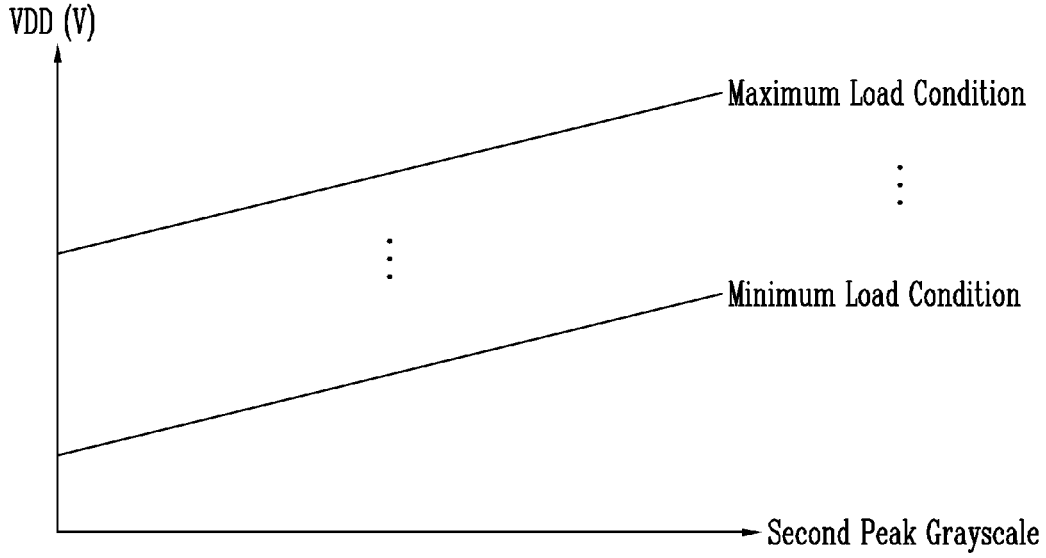
FIG. 10 graph illustrates an example of a first power voltage based on the load value of input image data and a second peak grayscale value.

FIG. 4 is a block diagram illustrating an embodiment of power controller 600 included in or coupled to the display device of FIG. 1. FIG. 5 is a block diagram illustrating an embodiment of a peak grayscale reference value generator included in or coupled to the power controller of FIG. 4. FIGS. 6 to 9 are graphs illustrating examples of characteristics and operations of the peak grayscale reference value generator of FIG. 5. FIG. 10 is a graph illustrating an example of a voltage of a first power controlled according to a load value of input image data and a second peak grayscale value.

As described with reference to FIG. 1, to prevent or reduce the degree of visibility reduction that may occur by controlling the voltage level of the first power VDD, according to one or more embodiments power controller 600 may control the voltage level of the first power VDD in correspondence with the load value and the peak grayscale value (e.g., a first peak grayscale value) of each of the blocks BLK. In this way, each block BLK may have one or more corresponding first peak grayscale values, and over all or a predetermined number of the blocks a plurality of first peak grayscale values are generated.

In one embodiment, power controller 600 may not simply generate a power control signal PCS for controlling the voltage level of the first power VDD based on one (for example, the largest grayscale value) of all or a predetermined number of grayscale values of the display panel 100, but may determine a peak grayscale value (e.g., a second peak grayscale value) to control the voltage level of first power VDD.

To this end, the power controller 600 may calculate a peak grayscale reference value RFV based on the total load value of the display panel 100, the load value of each of the blocks BLK and the first peak grayscale value, and may determine the second peak grayscale value PGS as the first peak grayscale value that satisfies a condition of the peak grayscale reference value RFV among the first peak grayscale values, either on a per block basis, among neighboring blocks, or among all of the blocks. The peak grayscale reference value RFV may therefore serve as a reference for determining a final peak grayscale value (e.g., second peak grayscale value PGS) used to control the voltage level of the first power VDD, among the first peak grayscale values.

Referring to FIGS. 3 and 4, the power controller 600 may include a first load calculator 610, a second load calculator 620, a grayscale value calculator 630, a peak grayscale reference value generator 640, a peak grayscale value calculator 650, a power control signal generator 660, and a memory 670.

The first load calculator 610 may generate first load data FLD by calculating the total load value (or the first load value) of the display panel 100. The second load calculator 620 may generate second load data SLD by calculating the load values (or second load values) for each of the blocks BLK01 to BLK35 of the display panel 100. Thus, the first load data FLD may include the total load value of the display panel 100, and the second load data SLD may include the load values for corresponding ones of the blocks BLK01 to BLK35.

The grayscale value calculator 630 may generate block grayscale data BGS by calculating the first peak grayscale values for each of the blocks BLK01 to BLK35 of the display panel 100. Here, the first peak grayscale value may correspond to the largest grayscale value from among the grayscale values of the pixels divided by a corresponding one of the blocks BLK01 to BLK35. The block grayscale data BGS may include the first peak grayscale values corresponding to each of the blocks BLK01 to BLK35.

The first load data FLD may be provided to the peak grayscale reference value generator 640 and the power control signal generator 660, the second load data SLD may be provided to the peak grayscale reference value generator 640, and the block grayscale data BGS may be provided to the peak grayscale reference value generator 640 and the peak grayscale value calculator 650.

The peak grayscale reference value generator 640 may generate the peak grayscale reference value RFV based on the first load data FLD, the second load data SLD, and the block grayscale data BGS.

FIG. 5 may describe an example in which the peak grayscale reference value generator 640 generates the peak grayscale reference value RFV. Referring to FIG. 5, the peak grayscale reference value generator 640 may include a first reference value calculator 641, a first weight calculator 642, a second weight calculator 643, a third weight calculator 644, and a second reference value calculator 645.

The first reference value calculator 641 may generate a first reference value FRV based on the first load data FLD. For example, referring to FIG. 6, the first reference value FRV may include first reference values FRV[1] to FRV[p] for respective grayscale areas GSA[1] to GSA[p]. As the total load value increases, the first reference values FRV[1] to FRV[p] corresponding to grayscale areas GSA[1] to GSA[p], respectively, may have larger values. In addition, as the grayscale values in the grayscale areas GSA[1] to GSA[p] increase (for example, an average value of the grayscale values in grayscale areas GSA[1] to GSA[p]) increases), values of the first reference values FRV[1] to FRV[p] may increase.

The first weight calculator 642 may calculate a first weight FWG based on the second load data SLD. The first weight FWG may correspond to weight data applied to the first reference value FRV, so that the load values of each of the blocks BLK01 to BLK35 (or the difference in load value between adjacent ones of or among blocks BLK01 to BLK35) are taken into consideration as a basis for determining the peak grayscale reference value RFV.

Figure 7:
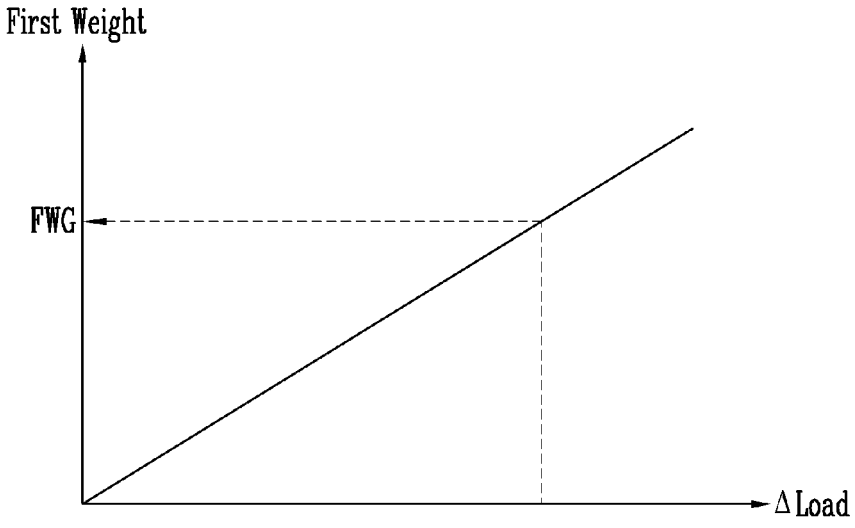

Referring to FIG. 7, in one embodiment the value of the first weight FWG may increase as the difference ΔLoad increases between a load value of a block (or a first reference block) having the largest load value among blocks BLK01 to BLK35 and an average value of load values of neighboring blocks. Neighboring blocks may be set as blocks closest to the first reference block. For example, in FIG. 3, when the first reference block is the eighteenth block BLK18, the neighboring blocks may be set as the blocks BLK10, BLK11, BLK12, BLK17, BLK19, BLK24, BLK25, and BLK26 closest to the eighteenth block BLK18. However, this is just an example and the neighboring blocks may be set in a different manner in other embodiments.

The second weight calculator 643 may calculate a second weight SWG based on the block grayscale data BGS. The second weight SWG may correspond to weight data applied to the first reference value FRV, so that the first peak grayscale values of each of the blocks BLK01 to BLK35 (for example, the first peak grayscale difference between adjacent ones of or among the blocks BLK01 to BLK35) is reflected on the peak grayscale reference value RFV.

Figure 8:
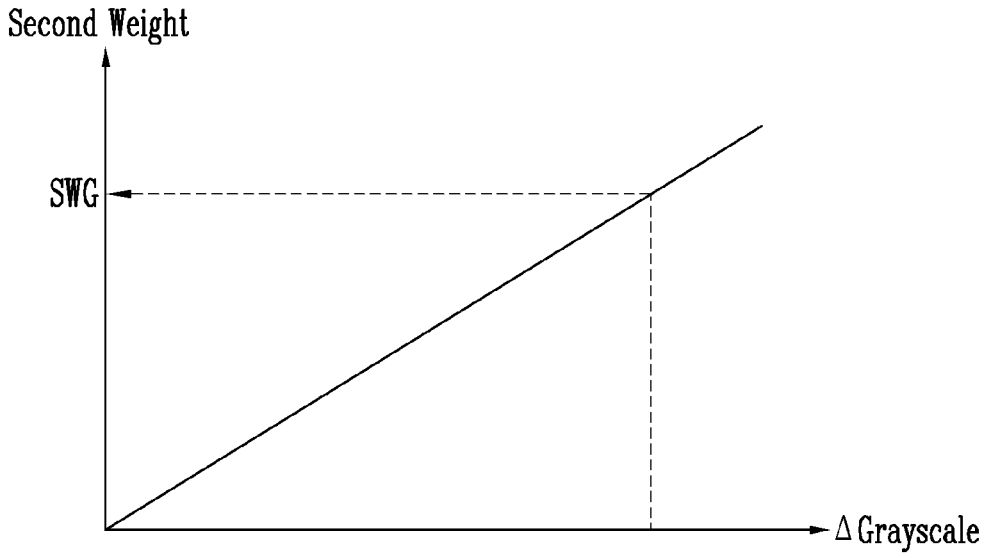
Figure 9:
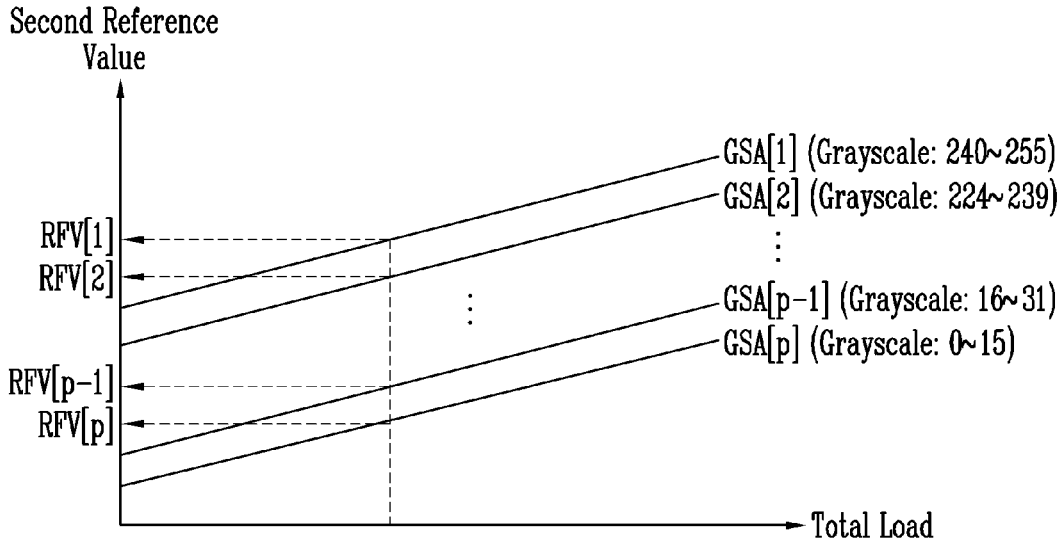

Referring to FIG. 8, in one embodiment the value of the second weight SWG may increase as the difference ΔGrayscale increases between a first peak grayscale value of a block (or a second reference block) having the largest first peak grayscale value among the blocks BLK01 to BLK35 and an average value of first peak grayscales of neighboring blocks. Neighboring blocks may be set in a manner similar to the neighboring blocks of the first reference block.

The third weight calculator 644 may calculate a third weight TWG to be applied to the first reference value FRV based on the first weight FWG and the second weight SWG. The third weight calculator 644 may extract (e.g., determine) the first reference block and the second reference block based on the second load data SLD and the block grayscale data BGS.

When the first reference block and the second reference block are the same block, the third weight calculator 644 may calculate the third weight TWG by based on both the first weight FWG and the second weight SWG. For example, the third weight calculator 644 may calculate the third weight TWG by adding the first weight FWG and the second weight SWG. When the first reference block and the second reference block are different blocks, the third weight calculator 644 may calculate the third weight TWG to prevent a separate weight from being reflected on the first reference value FRV. For example, the third weight calculator 644 may calculate the third weight TWG having a value of 0.

The second reference value calculator 645 may calculate a second reference value (or the peak grayscale reference value RFV) by applying the third weight TWG to the first reference value FRV. For example, the second reference value calculator 645 may calculate peak grayscale reference values RFV[1] to RFV[p] of FIG. 9 by adding the third weight TWG to each of the first reference values FRV[1] to FRV[p] of FIG. 6.

The peak grayscale value calculator 650 may calculate the second peak grayscale value PGS based on the peak grayscale reference value RFV and the block grayscale data BGS. For example, the peak grayscale value calculator 650 may calculate the first peak grayscale value that satisfies the condition of the peak grayscale reference value RFV, among the first peak grayscale values in the block grayscale data BGS. The result of this calculation may correspond to the second peak grayscale value PGS.

In an embodiment, the peak grayscale value calculator 650 may calculate the second peak grayscale value PGS by sequentially determining whether the first peak grayscale values of the blocks BLK01 to BLK35 satisfy the condition of the peak grayscale reference values RFV[1] to RFV[p] corresponding to the grayscale areas GSA[1] to GSA[p], respectively.

In one embodiment, the peak grayscale value calculator 650 may first determine whether the first peak grayscale values satisfy the condition of the peak grayscale reference value RFV[1] of the first grayscale area GSA[1]. For example, referring to FIG. 9, when the peak grayscale reference value RFV[1] for the first grayscale area GSA[1] (for example, 240 grayscale to 255 grayscale) is p, in a case where the number of first peak grayscale values in the first grayscale area GSA[1] is equal to or greater than p, the peak grayscale value calculator 650 may calculate a maximum grayscale value (e.g., 255 grayscale) in the first grayscale area GSA[1] as the second peak grayscale value PGS.

When the number of first peak grayscale values in the first grayscale area is less than p, the peak grayscale value calculator 650 may additionally determine whether the first peak grayscale values satisfy the condition of the grayscale reference value RFV[2] of the second grayscale area GSA [2]. At this time, when the peak grayscale reference value RFV[2] for the second grayscale area GSA[2] (for example, 224 grayscale to 239 grayscale) is q, in a case where the number of first peak grayscale values in the second grayscale area GSA[2] is equal to or greater than q, the peak grayscale value calculator 650 may calculate a maximum grayscale value (for example, 239 grayscale) in the second grayscale area GSA[2] as the second peak grayscale value PGS.

As described above, the peak grayscale value calculator 650 may calculate the second peak grayscale value PGS by sequentially determining whether the grayscale values satisfy the condition of the corresponding peak grayscale reference value with respect to the peak grayscale reference values RFV[1] to RFV[p] corresponding to respective ones of grayscale areas GSA[1] to GSA[p].

When the peak grayscale reference value RFV is relatively large (e.g., above a predetermined level), the number of cases where the first peak grayscale values satisfy the peak grayscale reference value RFV corresponding to the corresponding grayscale area may relatively decrease. Accordingly, the second peak grayscale value PGS calculated by the peak grayscale value calculator 650 may have a relatively small value. When the second peak grayscale value PGS decreases (e.g., as described with reference to FIG. 1), the voltage level of the first power VDD generated based on the power control signal PCS may be relatively low.

Figure 6:
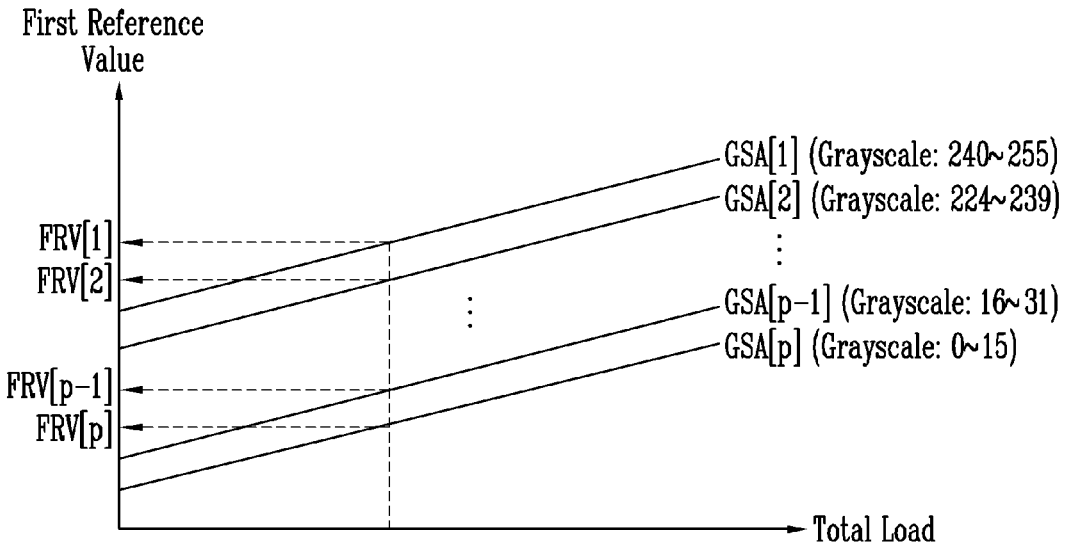
FIGS. 6 to 9 illustrate examples of characteristics and operations relating to embodiments of a peak grayscale reference value generator.

On the other hand, as described with reference to FIGS. 5 and 6, as the total load value has a relatively larger value, the peak grayscale reference value RFV (or the first reference value FRV) of the corresponding grayscale area may have a relatively larger value. Accordingly, the voltage level of the first power VDD may be relatively decreased. When the total load value of the display panel 100 is large (e.g., above a predetermined level), since the visual recognition ability of a user for a luminance change decreases, a reduction in visibility of the displayed image may not occur or be perceptible, even though the voltage level of the first power VDD is relatively decreased by increasing the peak grayscale reference value RFV.

In addition, as described with reference to FIGS. 5 and 7, the value of the first weight FWG may increase as the difference ΔLoad between the load value of the first reference block and the average value of the load values of the neighboring blocks increases, and thus the peak grayscale reference value RFV may have a large value. Accordingly, the voltage level of the first power VDD may be relatively decreased. When the difference of the load value between the first reference block and the neighboring blocks is large (e.g., above a predetermined level), since a user visual recognition ability for the luminance change decreases, the reduction of the visibility may not occur or be mitigated, even though the voltage level of the first power VDD is relatively decreased by increasing the peak grayscale reference value RFV.

In addition, as described with reference to FIGS. 5 and 8, the second weight SWG may increase as the difference ΔGrayscale between the first peak grayscale value of the second reference block and the average value of the first peak grayscales of the neighboring blocks increases, and thus the peak grayscale reference value RFV of the corresponding grayscale area may have a large value. Accordingly, the voltage level of the first power VDD may be relatively decreased. When the difference of the first peak grayscale value between the second reference block and the neighboring blocks is large (e.g., above a predetermined level), since a user visual recognition ability for the luminance change decreases, the reduction of the visibility may not occur or be mitigated, even though the voltage level of the first power VDD is relatively decreased by increasing the peak grayscale reference value RFV.

However, when the first reference block and the second reference block are not the same (e.g., when the block having the largest load value among the blocks BLK01 to BLK35 and the block having the largest first peak grayscale value are different), visual recognition may be adversely affected due to the luminance change when both the first weight FWG based on the load value of blocks BLK01 to BLK35 and the second weight SWG based on the first peak grayscale value of blocks BLK01 to BLK35 are reflected on the peak grayscale reference value RFV. Accordingly, as described with reference to FIG. 5, third weight calculator 644 may calculate the third weight TWG according to whether the first reference block and the second reference block are the same block.

As described above, the peak grayscale reference value generator 640 may calculate the peak grayscale reference value RFV based on the load value and the first peak grayscale value of each of the blocks BLK01 to BLK35, and the peak grayscale value calculator 650 may determine the second peak grayscale value PGS for preventing or mitigating visibility reduction due to a luminance change by calculating the second peak grayscale value PGS in correspondence with peak grayscale reference value RFV.

The power control signal generator 660 may generate the power control signal PCS based on the first load data FLD and the second peak grayscale value PGS. The power control signal generator 660 may generate the power control signal PCS to control the voltage of the first power VDD to a power level corresponding to the total load value of the display panel 100 and the second peak grayscale value PGS in the first load data FLD. The power supply 500 of FIG. 1 may vary the voltage level of the first power VDD based on the power control signal PCS. For example, the power control signal PCS may correspond to a voltage gain for the voltage level of the first power VDD.

As shown in FIG. 10, the voltage level of the first power VDD generated based on the power control signal PCS may have a larger value as the total load value of the display panel 100 increases and may have a larger value as the second peak grayscale value PGS increases.

In an embodiment, the power control signal generator 660 may generate the power control signal PCS based on a first lookup table LUT1 and a second lookup table LUT2 previously stored in the memory 670. The first lookup table LUT1 may include the voltage gain (or a first voltage gain) for the power level of the first power VDD corresponding to the total load value of the display panel 100. The second lookup table LUT2 may include the voltage gain (or a second voltage gain) for the power level of the first power VDD corresponding to the second peak grayscale value PGS. The power control signal generator 660 may generate the power control signal PCS by multiplying the first voltage gain and the second voltage gain.

However, the configuration in which the power control signal generator 660 generates the power control signal PCS is not limited thereto. For example, the power control signal generator 660 may generate the power control signal PCS through a preset operation equation.

As described with reference to FIGS. 4 to 10, according to embodiments the power controller 600 may generate the power control signal PCS based on the load value and the first peak grayscale value of each of the blocks BLK01 to BLK35. Accordingly, the power controller 600 may control the voltage level of the first power VDD to reduce or minimize (or eliminate) visibility reduction due to the luminance change (for example, a luminance decrease).

Figure 11:
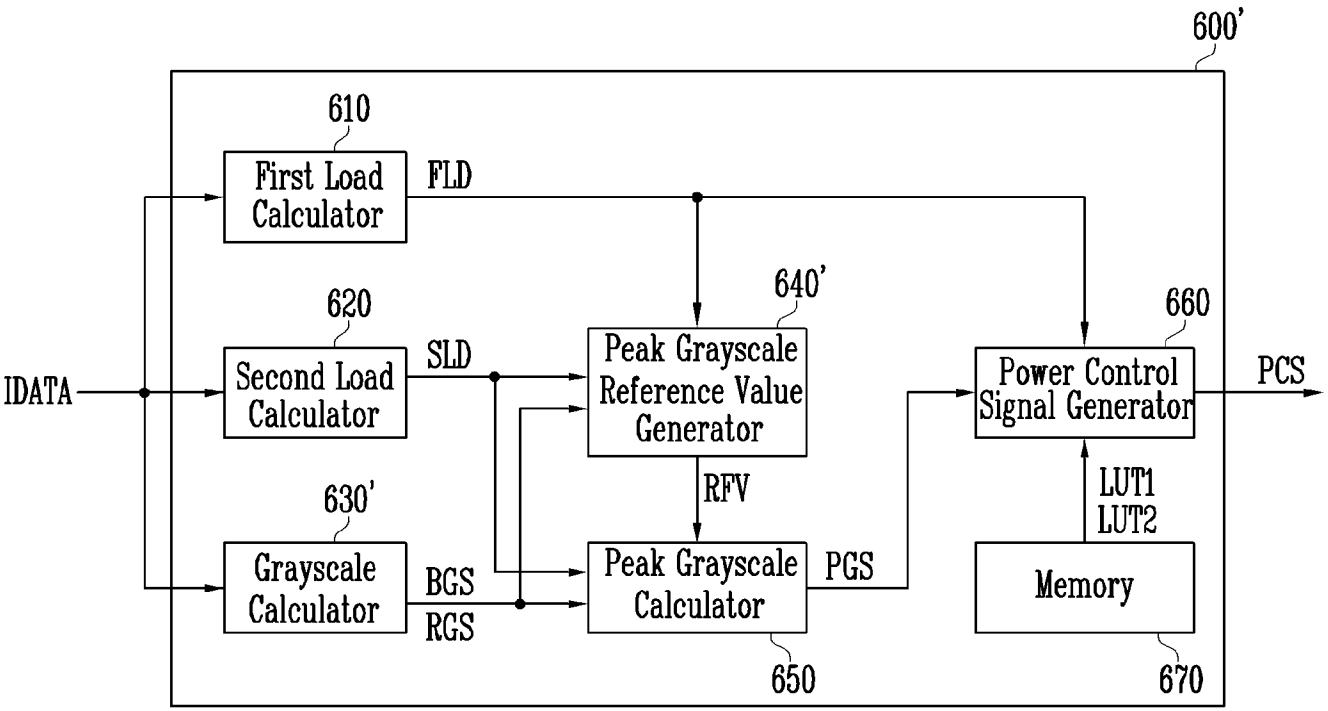
FIG. 11 illustrating an embodiment of a power controller.
Figure 12:
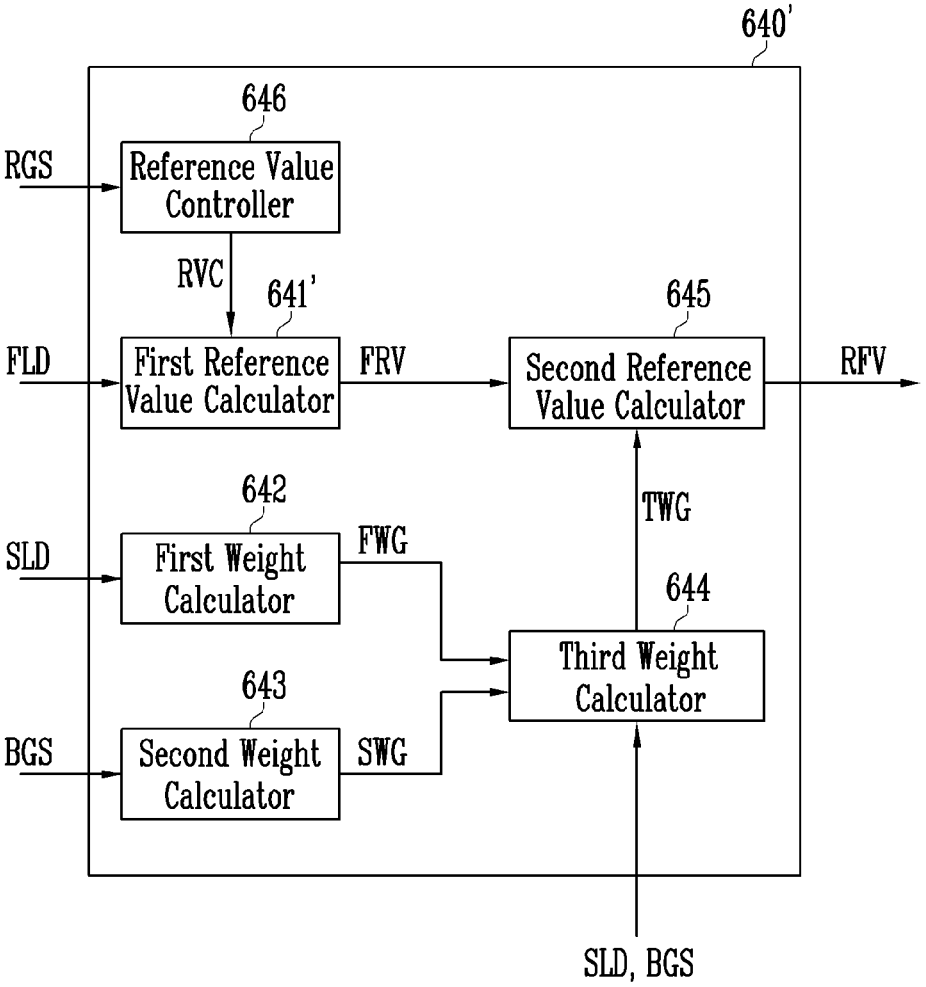
FIG. 12 illustrates an embodiment a peak grayscale reference value generator.

FIG. 11 is a block diagram illustrating an embodiment of a power controller 600', which, for example, may be included in the display device of FIG. 1. FIG. 12 is a block diagram illustrating an embodiment of a peak grayscale reference value generator 640' in the power controller 600' of FIG. 11. The power controller 600' of FIG. 11 and the peak grayscale reference value generator 640' of FIG. 12 may be substantially the same as the power controller 600 of FIG. 4 and the peak grayscale reference value of FIG. 5, respectively, for example, except for components included to perform the elements described below.

Referring to FIG. 11, the power controller 600' may include the first load calculator 610, the second load calculator 620, a grayscale value calculator 630', a peak grayscale reference value generator 640', the peak grayscale value calculator 650, the power control signal generator 660, and the memory 670.

The grayscale value calculator 630' may generate a grayscale ratio data RGS based on the input image data IDATA. The grayscale ratio data RGS may correspond, for example, to a ratio of colors of light emitted by the light emitting element LD of FIG. 2 included in the pixels.

In one embodiment, the grayscale ratio data RGS may include information on the ratio of an average value of grayscale values corresponding to pixels including a light emitting element LD of FIG. 2 emitting red light, an average value of grayscale values corresponding to pixels including a light emitting element LD of FIG. 2 emitting green light, and an average value of grayscale values corresponding to pixels including a light emitting element LD of FIG. 2 emitting blue light. For example, when the average value of the grayscale values corresponding to the pixels including the light emitting element LD of FIG. 2 emitting red light, the average value of the grayscale values corresponding to the pixels including the light emitting element LD of FIG. 2 emitting green light, and the average value of the grayscale values corresponding to the pixels including the light emitting element LD of FIG. 2 emitting blue light are the same, the grayscale ratio data RGS may include information on a ratio of 1:1:1. The grayscale value calculator 630' may provide the grayscale ratio data RGS to peak grayscale reference value generator 640'.

Referring to FIG. 12 the peak grayscale reference value generator 640' may include a first reference value calculator 641', the first weight calculator 642, the second weight calculator 643, the third weight calculator 644, the second reference value calculator 645, and a reference value controller 646.

The reference value controller 646 may generate a reference value control signal RVC for controlling values of the first reference values FRV[1] to FRV[p] in the first reference value FRV, based on the grayscale ratio data RGS.

The material used in the light emitting element LD of FIG. 2 may correspond to the color of light emitted by the light emitting element LD of FIG. 2 in the pixel. Accordingly, the amount of driving current for each pixel may be different to express the same grayscale value. For example, for the same grayscale value, the amount of driving current for a pixel emitting red light may be greater than the amount of driving current for a pixel emitting green light. As another example, for the same grayscale value, the amount of driving current for a pixel emitting green light may be greater than the amount of driving current for a pixel emitting blue light.

Accordingly, since the voltage level of the first power VDD for one pixel may be different for another pixel that emits a different color of light, reference value controller 646 may control the size of the first reference value FRV generated by the first reference value calculator 641' based on ratio data RGS.

For example, when the average value of the grayscale values corresponding to pixels emitting red light is relatively greater than an average value of the grayscale values corresponding to pixels emitting light of one or more different colors, the first reference value calculator 641' may generate a first reference value FRV having a relatively small value based on a corresponding grayscale ratio data RGS. In this case, since the peak grayscale reference value RFV decreases in correspondence with the first reference value FRV having the relatively small value, the second peak grayscale value PGS satisfying the condition of the corresponding peak grayscale reference value RFV may be relatively increased. Since the voltage level of the first power VDD generated based on the power control signal PCS is relatively increased, the amount of driving current for the pixel may be sufficiently secured.

As another example, when the average value of the grayscale values corresponding to the pixels emitting blue light is relatively greater than an average value of the grayscale values corresponding to the pixels emitting light of one or more different colors, the first reference value calculator 641' may generate a first reference value FRV having a relatively large value based on a corresponding grayscale ratio data RGS. In this case, since the peak grayscale reference value RFV increases in correspondence with the first reference value FRV having the relatively large value, the second peak grayscale value PGS satisfying the condition of the corresponding peak grayscale reference value RFV may be relatively decreased. Accordingly, the voltage level of the first power VDD generated based on the power control signal PCS may be relatively decreased, but the average value of the grayscale values corresponding to the pixels emitting blue light is greater than the average value of the grayscale values corresponding to pixels emitting light of one or more different colors. Thus the amount of driving current for the pixel may be sufficiently secured.

In accordance with one embodiment, a controller in or coupled to a display device controls the level of a power voltage of a display panel to reduce power consumption and/or to improve the quality of a displayed image. This may involve, for example, reducing or eliminating adverse effects by preventing a reduction in quality to changes in visibility recognition of a luminance change of the displayed image.

The controller may correspond to any of the embodiments of the controllers desired herein. In one embodiment, the controller may execute instructions stored in a non-transitory computer-readable medium within the display device or coupled to the controller when the controller is also coupled to the display device. The instructions, when executed, may cause the controller to perform operates of the power controller and/or other features of the embodiments described herein.

In operation, the controller may calculate a first load value corresponding to pixels in a display panel, second load values corresponding to each of blocks included divided ones of the pixels, and first peak grayscale values corresponding to each of the blocks based on the input image data. The controller may generate a power control signal to change a voltage level of the power voltage based on the first load value, the second load values, and the first peak grayscale values.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments or operations of the apparatus embodiments herein.

The controllers, processors, devices, modules, calculators, units, multiplexers, generators, logic, interfaces, decoders, drivers, generators and other signal generating and signal processing features of the embodiments disclosed herein may be implemented, for example, in non-transitory logic that may include hardware, software, or both. When implemented at least partially in hardware, the controllers, processors, devices, modules, units, calculators, multiplexers, generators, logic, interfaces, decoders, drivers, generators and other signal generating and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, processors, devices, modules, units, calculators, multiplexers, generators, logic, interfaces, decoders, drivers, generators and other signal generating and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

The foregoing detailed description illustrates and describes the disclosure. In addition, the foregoing description merely shows and describes preferred embodiments of the disclosure, as described above, the disclosure may be used in various other combinations, modifications, and environments, and the disclosure may be changed or modified within the scope of the concept of the disclosure disclosed in this specification, the scope equivalent to the disclosed disclosure, and/or the skill or knowledge in the art. Accordingly, the detailed description of the disclosure is not intended to limit the disclosure to the disclosed embodiments. Also, the appended claims should be construed as including other embodiments. The embodiments may be combined to form additional embodiments.

What is claimed is:

1. A display device, comprising:

a pixel unit including pixels divided into blocks;

a timing controller configured to generate image data based on input image data;

a data driver configured to generate a data signal corresponding to the image data and supply the data signal to the pixels;

a power supply configured to supply a power voltage to the pixel unit; and a power controller configured to calculate a first load value corresponding to the pixels in the pixel unit, second load values corresponding to each of the blocks and first peak grayscale values corresponding to each of the blocks based on the input image data, and to generate a power control signal to change a voltage level of the power voltage based on the first load value, the second load values, and the first peak grayscale values.

2. The display device according to claim 1, wherein a value of the power voltage decreases as a difference of the second load value between a first reference block and one or more neighboring blocks increases, the first reference block having a largest second load value among the blocks.

3. The display device according to claim 1, wherein a value of the power voltage decreases as a difference of the first peak grayscale value between a second reference block and one or more neighboring blocks, the second reference block having a largest first peak grayscale value among the blocks.

4. The display device according to claim 1, wherein the power controller comprises:

a first load calculator configured to generate first load data by calculating the first load value;

a second load calculator configured to generate second load data by calculating the second load values; and a grayscale calculator configured to generate block grayscale data by calculating the first peak grayscale values.

5. The display device according to claim 4, wherein the first peak grayscale value corresponds to a largest grayscale value among grayscale values of a corresponding block among the blocks.

6. The display device according to claim 4, wherein the power controller comprises:

a peak grayscale reference value generator configured to generate a peak grayscale reference value based on the first load data, the second load data, and the block grayscale data;

a peak grayscale value calculator configured to calculate a second peak grayscale value based on the peak grayscale reference value and the block grayscale data; and a power control signal generator configured to generate the power control signal based on the first load data and the second peak grayscale value.

7. The display device according to claim 6, wherein the peak grayscale reference value generator comprises:

a first reference value calculator configured to generate a first reference value based on the first load data; and a second reference value calculator configured to generate a second reference value corresponding to the peak grayscale reference value based on the first reference value.

8. The display device according to claim 7, wherein the first reference value increases as the first load value increases.

9. The display device according to claim 7, wherein the peak grayscale reference value generator comprises:

a first weight calculator configured to calculate a first weight based on the second load data;

a second weight calculator configured to calculate a second weight based on the block grayscale data; and a third weight calculator configured to calculate a third weight based on the first weight and the second weight, and the second reference value calculator generates the second reference value by applying the third weight to the first reference value.

10. The display device according to claim 9, wherein a value of the first weight increases as a difference of the second load value between a first reference block and one or more neighboring blocks increases, the first reference block having a largest second load value among the blocks.

11. The display device according to claim 9, wherein a value of the second weight increases as a difference of the first peak grayscale value between a second reference block and one or more neighboring blocks, the second reference block having a largest first peak grayscale value among the blocks.

12. The display device according to claim 9, wherein the third weight calculator is configured to extract a first reference block and a second reference block having a largest first peak grayscale value among the blocks, the first reference block having a largest second load value among the blocks and the second reference block having a largest first peak grayscale value among the blocks.

13. The display device according to claim 12, wherein the third weight calculator is configured to calculate the third weight by adding the first weight and the second weight when the first reference block is same as the second reference block.

14. The display device according to claim 12, wherein the third weight calculator is configured to calculate the third weight having a value of 0 when the first reference block is different from the second reference block.

15. The display device according to claim 9, wherein the second reference value calculator generates the second reference value by adding the third weight to the first reference value.

16. The display device according to claim 6, wherein the peak grayscale value calculator is configured to calculate, as the second peak grayscale value, a first peak grayscale value that satisfies the peak grayscale reference value among the first peak grayscale values in the block grayscale data.

17. The display device according to claim 6, wherein a value of the power voltage increases as the first load value increases based on the power control signal.

18. The display device according to claim 6, wherein a value of the power voltage increases as the second peak grayscale value increases based on the power control signal.

19. The display device according to claim 7, wherein the grayscale calculator is configured to generate grayscale ratio data based on the input image data.

20. The display device according to claim 19, wherein the peak grayscale reference value generator comprises a reference value controller configured to generate a reference value control signal to control a size of the first reference value based on the grayscale ratio data.

* * * * *